US009456697B2

(12) United States Patent
Simitian

(10) Patent No.: US 9,456,697 B2
(45) Date of Patent: Oct. 4, 2016

(54) BENCH AND METHODS FOR MAKING THEREOF

(71) Applicant: Sarkis Simitian, Los Angeles, CA (US)

(72) Inventor: Sarkis Simitian, Los Angeles, CA (US)

( * ) Notice: Subject to any disclaimer, the term of this patent is extended or adjusted under 35 U.S.C. 154(b) by 0 days.

(21) Appl. No.: 14/873,122

(22) Filed: Oct. 1, 2015

(65) Prior Publication Data

US 2016/0095441 A1 Apr. 7, 2016

Related U.S. Application Data

(63) Continuation-in-part of application No. 29/504,085, filed on Oct. 1, 2014, now Pat. No. Des. 743,707.

(60) Provisional application No. 62/058,585, filed on Oct. 1, 2014.

(51) Int. Cl.

| | |
|---|---|
| ***A47C 11/00*** | (2006.01) |
| ***A47C 7/16*** | (2006.01) |
| ***A47C 3/00*** | (2006.01) |

(52) U.S. Cl.

CPC ..... *A47C 11/00* (2013.01); *A47C 3/00* (2013.01); *A47C 7/16* (2013.01)

(58) Field of Classification Search

CPC ..... A47C 11/00; A47C 3/00; A47C 7/16

USPC ..... 297/452.63, 452.1

See application file for complete search history.

(56) References Cited

U.S. PATENT DOCUMENTS

| | | | | |
|---|---|---|---|---|
| 2,888,305 | A * | 5/1959 | Perry | A47B 1/08 108/102 |
| 3,722,431 | A * | 3/1973 | Howard | A47B 3/00 108/157.13 |
| 3,743,353 | A * | 7/1973 | Lupinsky | A47B 85/00 297/411.42 |
| 4,235,473 | A * | 11/1980 | Aginar | A47C 4/022 297/440.19 |

* cited by examiner

*Primary Examiner* — Milton Nelson, Jr.
(74) *Attorney, Agent, or Firm* — Payam Moradian

(57) ABSTRACT

Provided is a bench comprising: a) a plurality of parallel middle members, each of the middle members having at least two openings; b) at least two crossbars with a first end and a second end, each of the crossbars configured to go through one of the two openings; c) a plurality of legs for attaching to the crossbars, the legs making contact with a ground; wherein the plurality of the middle members are spaced apart from each other in such configuration that each of the two openings align from one middle member to another, and each of the crossbars transverses one of the openings of the middle members to be attached to the legs at the first and the second end of the crossbar, a top surface of the middle members in the configuration attached to the legs defining a sitting area of the bench.

19 Claims, 9 Drawing Sheets

BENCH AND METHODS FOR MAKING THEREOF

CROSS-REFERENCE

The present application claims the benefit of U.S. Provisional Appl. No. 62/058,585, filed on Oct. 1, 2014, and in a continuation-in-part of U.S. Design application No. 29/504,085 filed on Oct. 1, 2014, both of which are incorporated herein by reference in their entirety.

BACKGROUND SECTION OF THE INVENTION

Many consumers prefer high end furniture that gives a luxurious look to a person's house or office. The problem with such furniture is that they are difficult to manufacture and assemble. In addition, the furniture may not have a luxurious feel and look, be sturdy and durable, and be capable of being manufactured at a reasonable price, and be available in a modular kit for assembly.

There is a need in the art for a bench that fulfills the above needs.

SUMMARY OF THE INVENTION

Provided is a bench comprising: a) a plurality of parallel middle members, each of the middle members having at least two openings; b) at least two crossbars with a first end and a second end, each of the crossbars configured to go through one of the two openings; c) a plurality of legs for attaching to the first end and the second end of the crossbars, the legs making contact with a ground; wherein the plurality of the middle members are spaced apart from each other in such configuration that each of the two openings align from one of the middle members to another; wherein each of the crossbars transverses one of the openings of the middle members to be attached to the legs at the first and the second end of the crossbar; wherein a top surface of the middle members in the configuration attached to the legs define a sitting area of the bench. Two of the U-shaped legs can be used, each of the U-shaped legs fabricated from a single piece of material. One of the two U-shaped legs can have a first vertical portion of higher height that a second vertical portion, the first vertical portion rising above the sitting area to cradle a cushion. All of the crossbars can be parallel to each other. The openings can be circular. The members can have a length, a width, and a thickness, and the middle members are positioned in relation to each other in such manner that the width of one member faces the width of another member, and the thickness of the middle members creates the sitting area of the bench. The bench can further comprise the crossbars having a plurality of diametrically spaced openings on a length of the crossbar, and the middle members having a channel that aligns with the openings on the crossbars. The bench can further comprise a fastener, the fastener attaching the middle member to the cross bar by travelling through the channel, then the diametrically spaced openings of the crossbar, and then a portion on the middle member on opposite side of which the fastener entered the diametrically spaced openings. The diametrically spaced openings can be configured to receive the fastener in a parallel fashion to a side of the middle member which is a width of the middle member. The bench can further comprise a front and a rear member placed on outside of the legs in parallel fashion to the middle members. Each of the front and the rear members can have two slots, each slot configured to accept a vertical portion of the leg. Each of the slots can have one or more receivers configured for receiving a fastener. Each leg can have two types of openings, with one type of opening configured for attachment to the crossbar and one type of opening configured for attachment to a front or a rear member. At least one of the middle members can be asymmetric. At least one of the middle members can have an asymmetric end to cradle a cushion. The bench can have a combination of asymmetric and symmetric middle members, the asymmetric members having portions that rise upward and limit lateral movement of a cushion. The middle members can have exposed ends without presence of a frame.

Provided is a bench comprising: a) a plurality of parallel middle members, each of the middle members having at least two openings through a thickness of the middle members, and two channels configured for accepting fasteners; b) two crossbars with a first end and a second end, each of the crossbars configured to go through one of the two openings, the crossbar further comprising a plurality of diametrically spaced openings along a length of the crossbar; c) two U-shaped legs for attaching to the first end and the second end of the crossbars, the legs making contact with a ground; d) a front member for attaching to outside of the two U-shaped legs; e) a rear member for attaching to outside of the two U-shaped legs; wherein the plurality of the middle members are spaced apart from each other in such configuration that each of the two openings align from one of the middle members to another; wherein each of the crossbars transverses one of the openings of the middle members to be attached to the legs at the first and the second end of the crossbar; wherein the diametrically spaced openings on the crossbar align with the channel on the middle members so that the middle members can be fastened to the crossbar; and wherein a top surface of the middle members in the configuration attached to the legs define a sitting area of the bench. One of the two U-shaped legs has a vertical portion that extends above the sitting area to cradle a cushion.

DETAILED DESCRIPTION OF THE INVENTION

Provided is a bench that is modular, flexible, customizable, and gives the consumer inputs as to using different materials, such as different wood species. The bench can be put together after an order is received, therefore occupying less storage space. The bench also has an aesthetically pleasant look.

Figure 1:
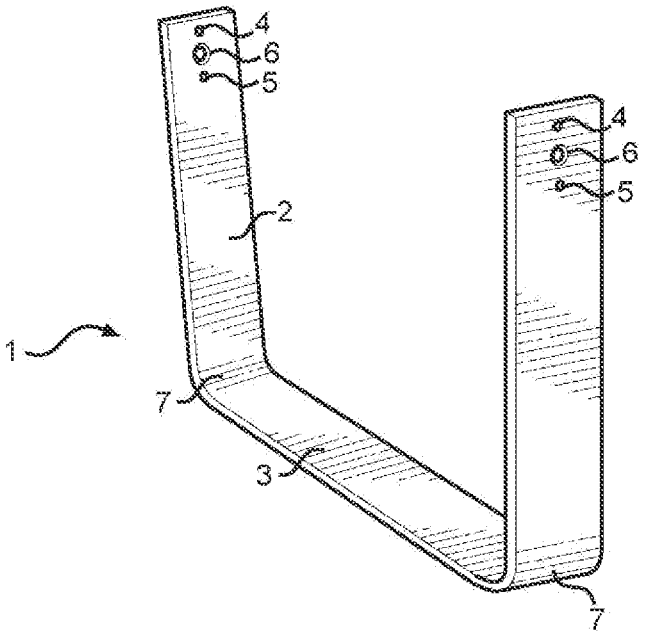
FIG. 1 illustrates a U-Shaped leg where both vertical portions of the leg have the same height.

FIG. 1 illustrates a first type of a U-Shaped leg 1 where each vertical portion 2 has the same height. The vertical portions 2 are connected through a horizontal portion 3. The U-shaped leg 1 is typically fabricated from a single piece of material. Typically, the U-shaped leg 1 is made from a single piece of metal that is bent in two places. The metal for the U-Shaped leg 1 can be steel, stainless steel, aluminum, and mild steel. The stainless steel can be ASTM A-304 stainless steel. U-shaped leg 1 can also be made from wood. Each corner of the U-shaped leg 1 can be made to be round. The thickness of the metal that is bent, particularly stainless steel, can be about 0.25 inches to about 1 inch, such as about 0.25 to about 0.5 inch, or such as about 0.30 inch to about 0.40 inch, such as about 0.375 inch. The width of the of the metal that is bent, particularly stainless steel, can be about one inch to about 6 inches, such as about 2 inches to about 4 inches, such as about 3 inches. The U-shaped leg 1 typically has a uniform thickness and a uniform width.

The vertical portions 2 and the horizontal portion 3 are perpendicular to each other as illustrated in FIG. 1. It is possible to have different angles between vertical portions 2 and the horizontal portion 3, such as about zero to 30 degrees variation from the perpendicular angle. The radius of the circular corners formed between the vertical portions 2 and the horizontal portion 3 can be about 0.5 inch to about 3 inch, such as about 1 inch to about 2 inches, such as about 1.5 inches.

Each vertical portion 2 of the U-shaped leg 1 as illustrated has three openings 4, 5, and 6 on each vertical portion 2. The middle opening 6 is used for attachment to a crossbar. Openings 4 and 5 are used for attaching the U-shaped leg 1 to the wood members.

Figure 2:
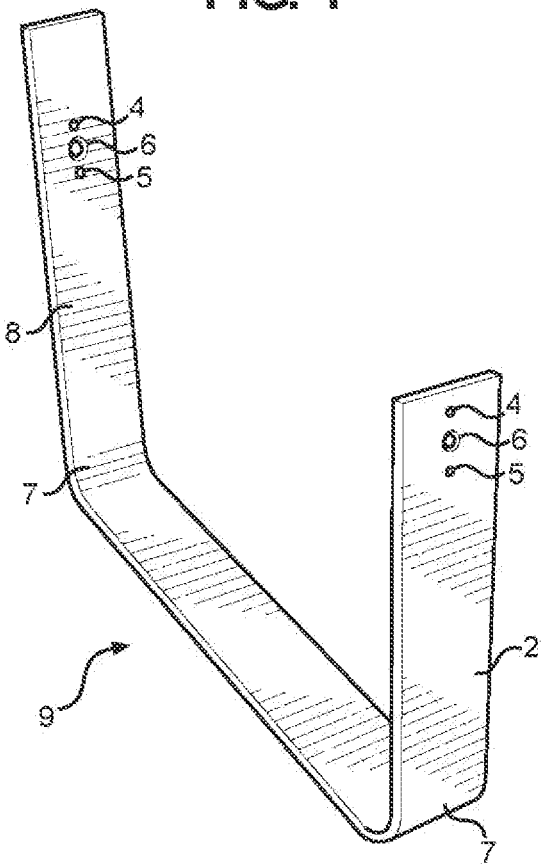
FIG. 2 illustrates a U-Shaped leg where the vertical portions have different heights.

FIG. 2 illustrates a U-Shaped leg 9 where the vertical portion 8 is taller than the vertical portion 2. Nevertheless, openings 4, 5, and 6 align and are positioned at the same elevation in relation to the floor (or horizontal portion 3).

The height of vertical portion 2 can be about 12 to about 24 inches, such as about 14 to about 18 inches, such as about 15 inches. The height of vertical portion 8 can be about 14 to about 24 inches, such as about 16 to about 20 inches, such as about 18 inches. The difference in height of vertical portion 2 and vertical portion 8 is typically the same as the height of cushion 26 that is placed on the bench. The cushion 26 as illustrated in FIG. 26 is three inches tall. The length from inside of vertical portion 2 and to inside of vertical portion 8 (a parallel line to the horizontal section 3) can be about 15 inches to about 30 inches, such as about 20 inches to about 25 inches.

Figure 3:
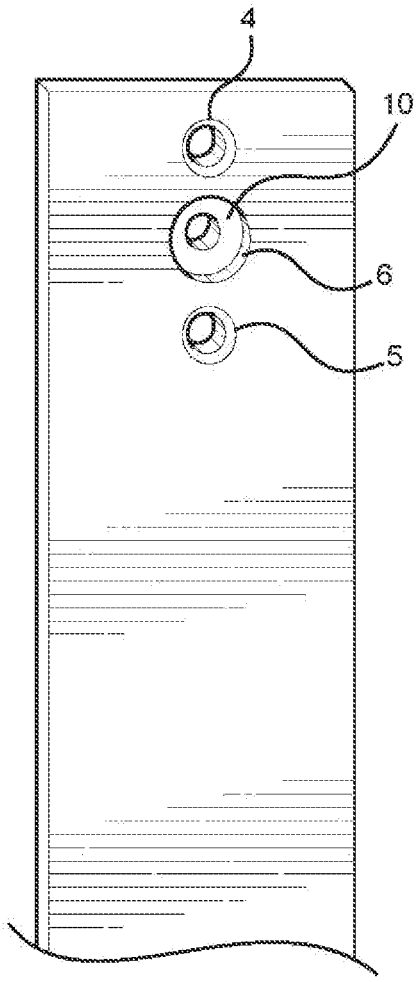
FIG. 3 is a close-up of the inside of the vertical portion of the U-shaped leg of FIG. 1.
Figure 4:
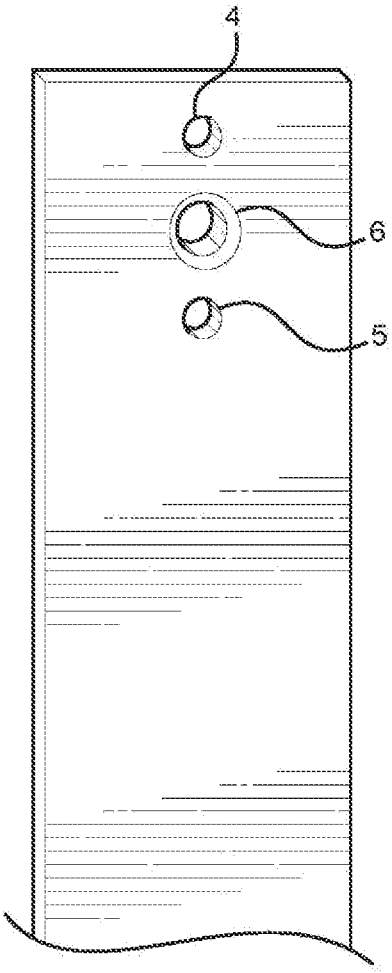
FIG. 4 is a close-up of the outside of the vertical portion of the U-shaped leg of FIG. 1.

FIGS. 3 and 4 illustrate openings 4, 5, and 6 on the vertical portion 2 or 8. FIG. 3 illustrates the openings from inside (where the two vertical portions 2 and/or 8 face each other) and FIG. 4 illustrates the openings from the outside. Openings 4 and 5 are screw holes that are countersunk from the inside so when a screw or other fastener is attached, the screw head is flush (same level) with the plane of the U-shaped leg member. Opening 6 has a counter sunk from the outside. The actual opening for all openings 4, 5, and 6 is a quarter of inch diameter, which can be varied depending on the type of the fastener. Opening 6 has a matching hole 10, which is configured to receive crossbar 11. Matching hole 10 has almost the same diameter as crossbar 11 to provide a tight fit. The matching hole 10 is illustrated as being drilled at half depth (half the thickness of the vertical portion 2 or 8).

Figure 5:
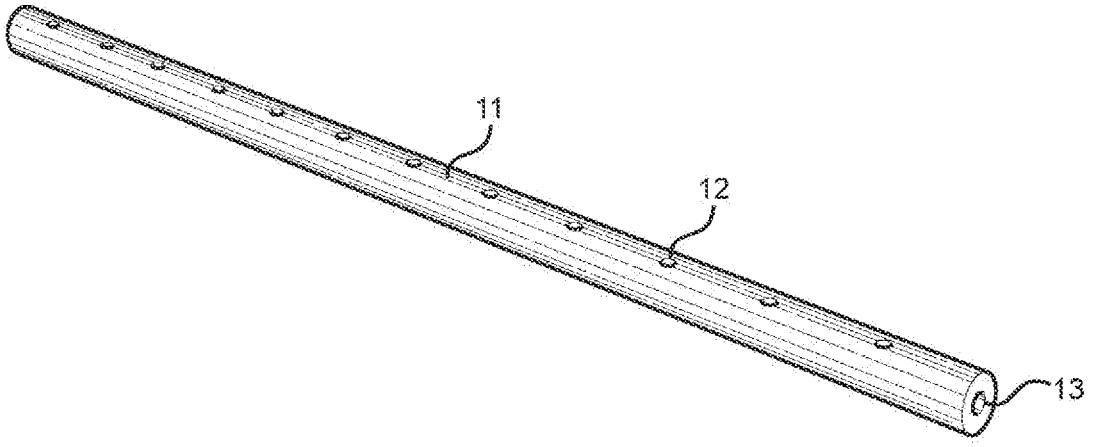
FIG. 5 illustrates a crossbar.

FIG. 5 illustrates crossbar 11. Crossbar 11 is typically made from a single piece of material, such as steel, stainless steel, aluminum, and mild steel. The stainless steel can be ASTM A-304 stainless steel. Crossbar 11 is typically a round bar with flat perpendicular ends. The length of crossbar 11 is slightly larger than the distance from one vertical portion 2 and/or 8 to compensate for the depth of matching hole 10 on both vertical portions 2 and/or 8. The depth of matching hole 10 is approximately one half of the thickness of vertical portion 2 and/or 8 of leg 1.

Figure 21:
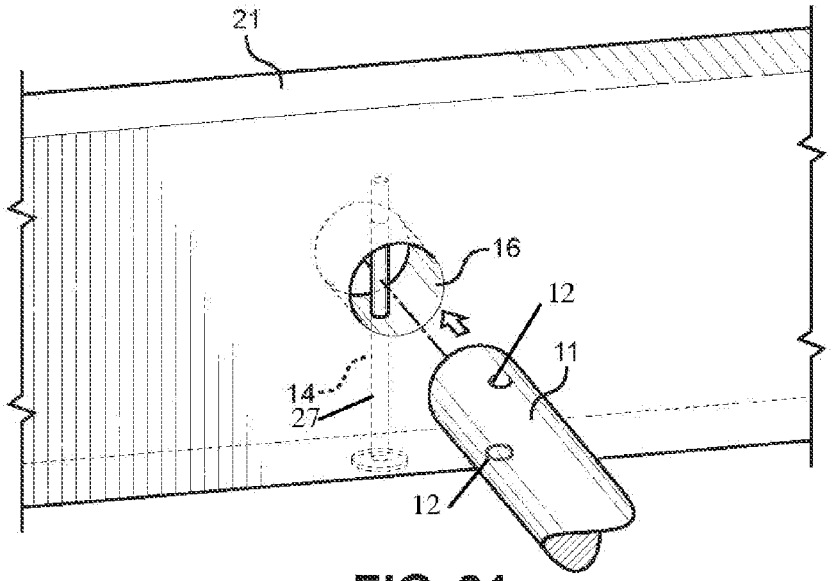
FIG. 21 illustrates fastening of the crossbar to the middle wood member.

There are a plurality of openings 12 along the surface of the crossbar 11. Opening 12 is configured to receive a screw or other fastener can enter inside the crossbar from one surface and exit through a diametrically opposed opening. As illustrated in FIG. 21, a pair of diametrically opposes openings 12 are on crossbar 11 (the lower opening would not be visible in this view and is shown in this figure for illustration). The diametrically opposed openings 12 are aligned in a configuration that allows a fastener 14 to enter one of the openings 12 and exit through the other opening 12. The screw (fastener) 14 creates a channel 27 in middle wood member 21 and transverses the opening 16 and is fastened to the middle wood member 21. An opening to the outside is not created on other side of the middle wood member. Each pair of openings 12 that are placed in a diametrically opposed position are configured to be used for attaching the crossbar at that opening to a wood member. The openings 12 are configured so that a screw or other fastener can go through a cross-section of the crossbar. Openings 13 are placed at each end of the crossbar. Openings 13 can have an internal thread to accommodate a fastener such as a screw from outside surface of vertical portions 2 and/or 8 through opening 6.

Figure 6:
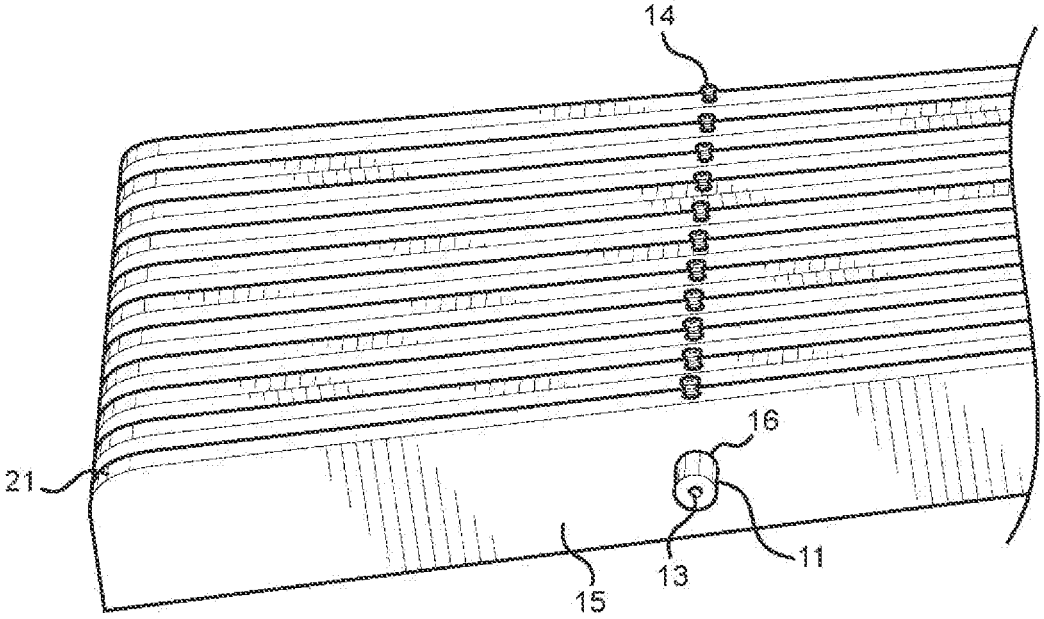
FIG. 6 illustrates one of the two crossbars going through the middle wood members in a transverse direction, and being fastened by a fastener that goes through an opening on the bottom side of the wood member.

FIG. 6 illustrates wood members 21 having opening 16 which align from one wood member 21 to another. The crossbar 11 goes through openings 16 in a perpendicular direction in which wood members 21 are placed. Wood members 21 are placed in a parallel fashion to each other with the length of the wood member 21 defining the length of the resulting bench. Wood members 21 are placed so that the width of the woods members 21 defines the top of the bench, with gaps between wood members 21 dictated by openings 12 on cross-member 11 and the actual width of wood member 15. As illustrated in FIG. 6 (which shows the bottom of the resulting bench), a screw 14 goes through wood member 21 into crossbar 11, and then exits the crossbar 11 and is fastened to wood member 21.

Figure 8:
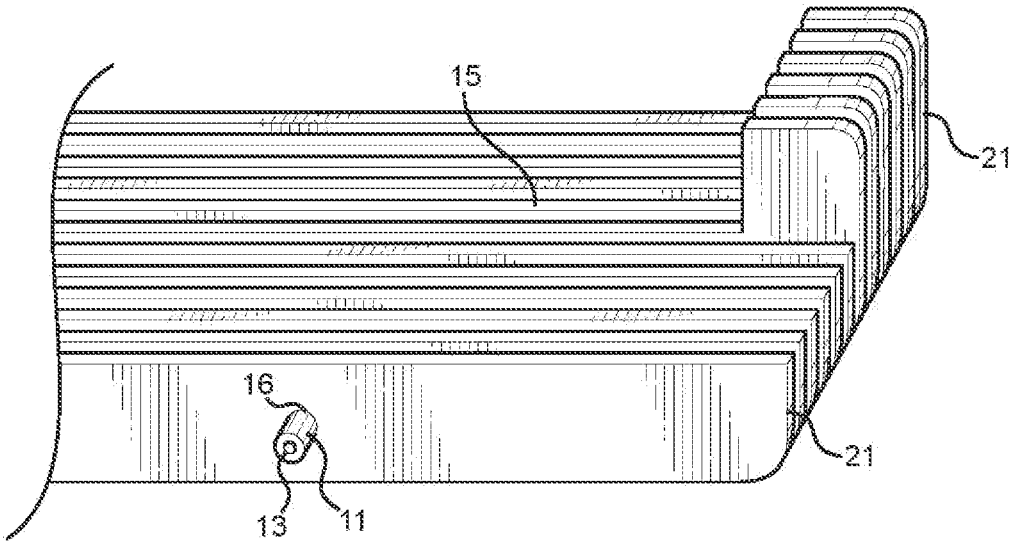
FIG. 8 is a top perspective view of the crossbar being placed through the opening of the middle wood members.
Figure 9:
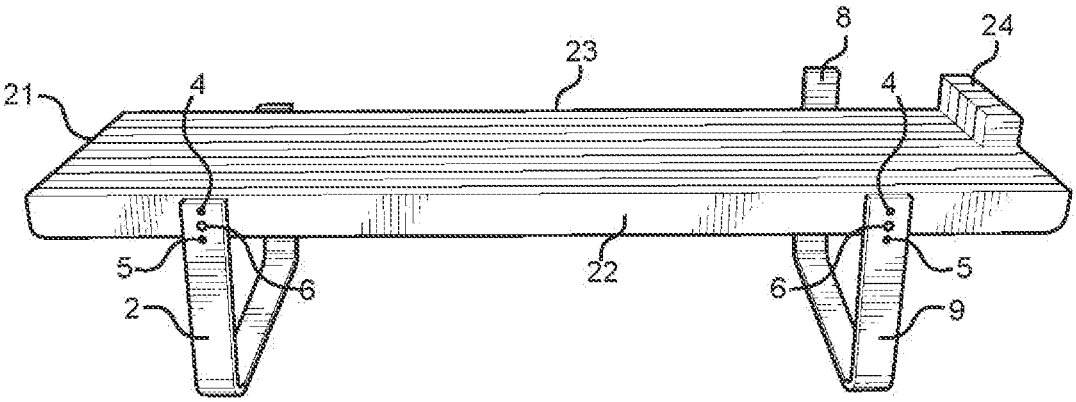
FIG. 9 illustrates attachment of the U-shaped legs to the two crossbars that has traveled through the openings of the middle wood members.

FIG. 8 illustrates a second crossbar 11 which is placed through middle wood members 21 closer to the other end of middle wood members 21. Each middle wood member has two openings 16, and is configured to receive two crossbars 16. The openings 16 in middle wood members 21 dictate where the legs of the bench are attached and the distance between the U-shaped legs 1, 9. FIG. 9 illustrates the other end of the bench with middle wood members 21, viewed from the top side. There are two types of middle wood members 21, symmetric middle wood member 22, and asymmetric middle wood member 23. The asymmetric member 23 has a raised end 24 to cradle a cushion or other objects placed on the bench. It is also possible to use only one type of middle wood members 22 or 23 for the bench rather than two types of middle wood members. All wood members illustrated in FIGS. 6, 8, 9, and 10 are middle wood members 21.

Figure 7:
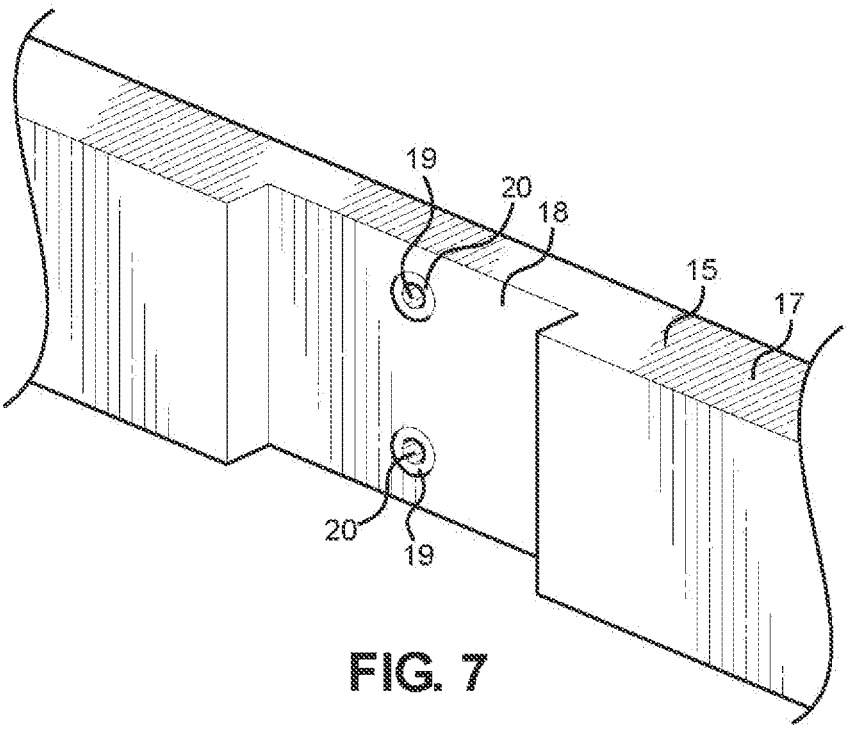
FIG. 7 illustrates a slot in the rear and/or front wood member.

FIG. 7 illustrates wood member 15. In this case, the wood member can be a front or a rear wood member 17. The front wood member 17A is the first member that is lined up and the rear wood member 17B the last member, and both of them are the last wood members 15 that are assembled. The front or rear wood members 17 each have two slots each 16. The slots 18 are configured to receive U-shaped legs 1 and 9. Each slot 18 can have a fattener receiver 19, which can be made by drilling a hole in wood member 17 and placing a wood insert 20 inside the hole. Wood insert 20 has threads that are complementary to a fastener. The vertical portions 2 and 9 have openings 4 and 5 which align with fastener receivers 19. The rear and front wood members 17 are fastened to the vertical portion 2 and 9 of the U-shaped leg by having a fastener go through from inside of the U-shaped leg through openings 4 and 5 and into the wood insert 20 of receivers 19.

Figure 10:
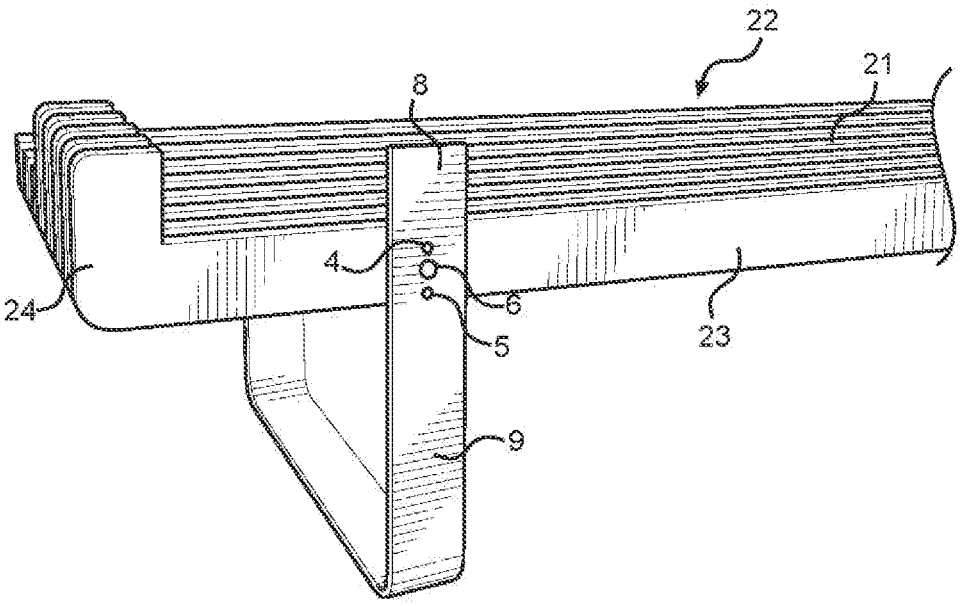
FIG. 10 illustrates a close-up of the attachment of the U-shaped leg having vertical portions of different heights.

FIGS. 9 and 10 illustrate the assembled bench before attachment of the front and rear wood members 17. Illustrated are middle wood members 21, which comprise symmetric middle wood members 22 and asymmetric middle wood member 23. The middle wood members 21 are held in place with two crossbars 11, which are attached to the U-shaped legs 2 and 9 at middle opening 6 on the U-shaped legs 2 and 9 with fasteners such as screws. At this point during assembly, the attachment of the U-shaped legs 2 and 9 can be considered a pivot joint and the legs 2 and 9 are locked in place. The next step is adding a fastener such as a screw to the taller vertical portion 8 rises above the top surface of the bench that defines a space for placing a cushion or other object. The taller vertical portion 8 and raised ends 24 typically rise above the top surface (plain) of the bench in approximately the same distance. Two U-shaped legs 2, 9 support middle wood members 21 which are spaced apart and attached to the crossbar 11.

Figure 11:
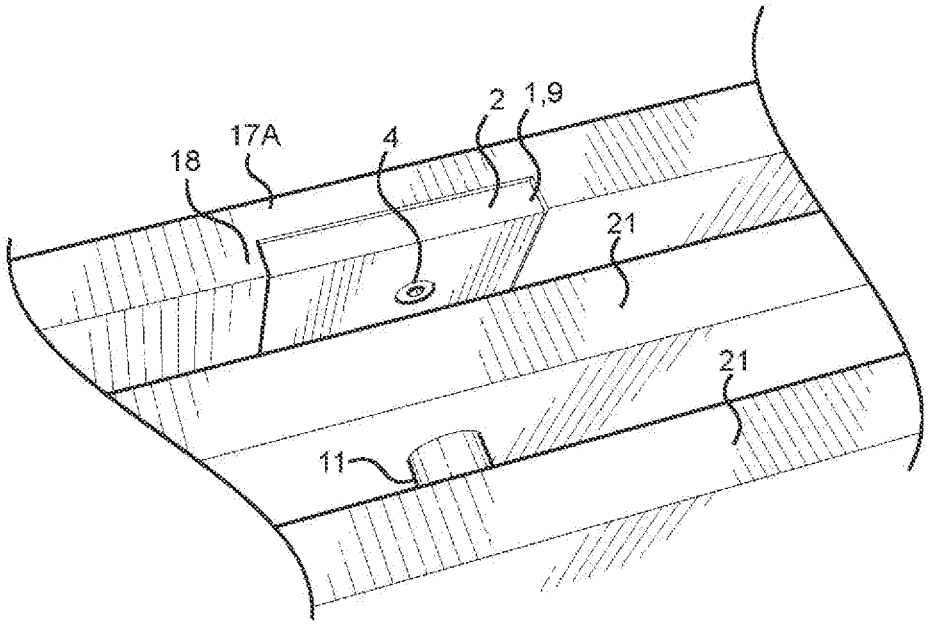
FIG. 11 is a close-up of the attachment of the U-shaped leg to the slot of a rear or front wood member.
Figure 12:
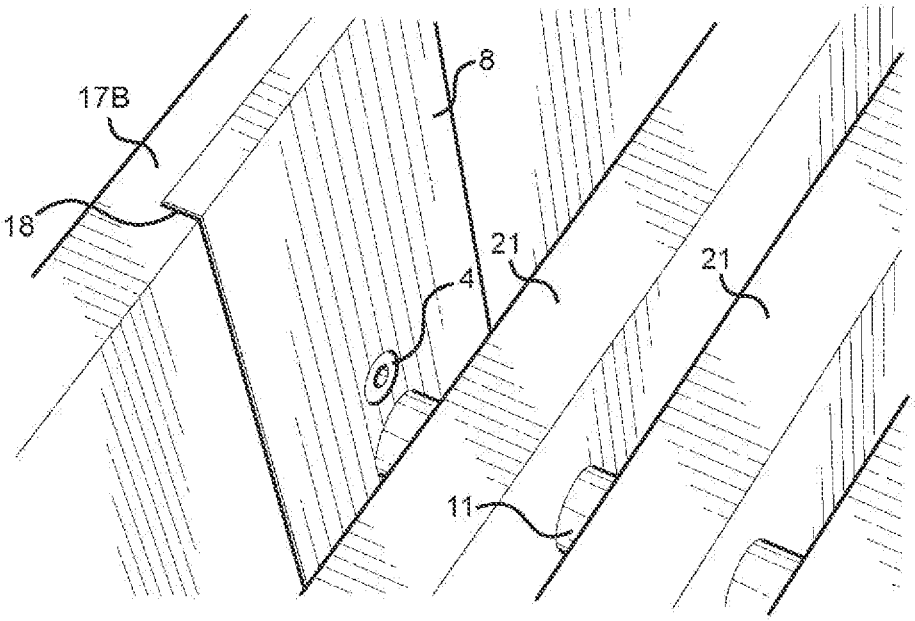
FIG. 12 is a close-up of the attachment of the U-shaped leg with a taller vertical portion to the slot of a rear wood member.

FIGS. 11 and 12 illustrate attachment of vertical portion 2 or 8 of U-shaped leg 1 or 9 to a front or rear wood member 17. Each vertical portion 2 is placed in slot 18, and a fastener such as a screw attached the vertical portion 2 or 8 to the front or rear wood member 17 through openings 4 and 5. Slots 18 provide rigidity to the bench. The screws used in openings 4 and 5 face the interior of the bench, leaving a clean and an aesthetic look on the outside. Three out of four U-shaped leg connections have the arrangement illustrated in FIG. 11, and one of the four U-shaped legs has the arrangement illustrated in FIG. 12. FIG. 12 illustrates the same concept of attaching a front or rear wood member 17 to a U-shaped leg 9, except in this case the taller vertical portion 8 of the U-shaped leg is attached. The taller vertical portion 8 is attached to the rear wood member 17B. The rear wood member 17B has a larger width than the other wood members 15, and the larger width is configured to match the height of the taller vertical portion 8 of the U-shaped leg 9, so that the taller vertical portion 8 of the U-shaped leg is complemented and/or enveloped by the rear wood member 17B.

Figure 13:
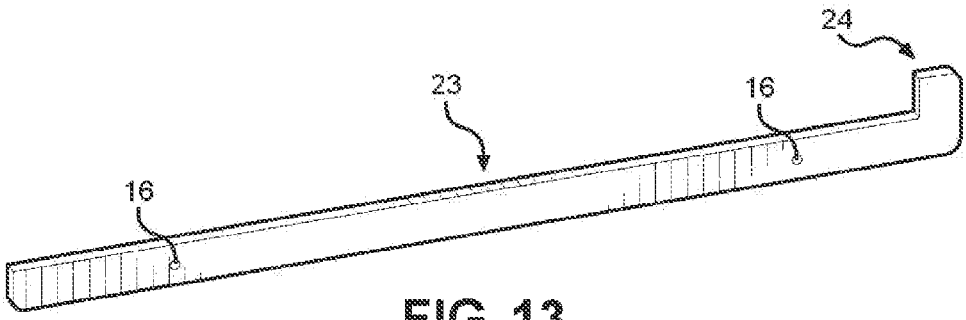
FIG. 13 illustrates an asymmetric middle wood member.
Figure 14:
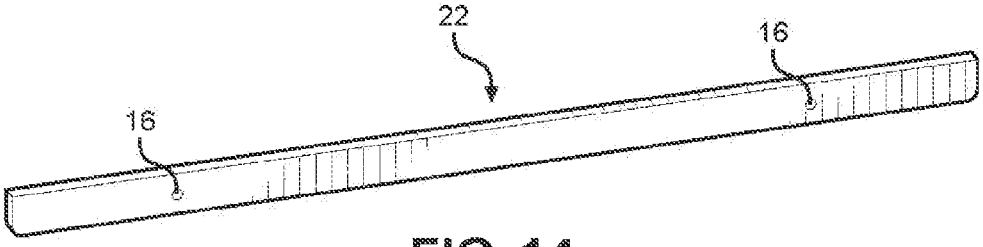
FIG. 14 illustrates a symmetric middle wood member.
Figure 15:
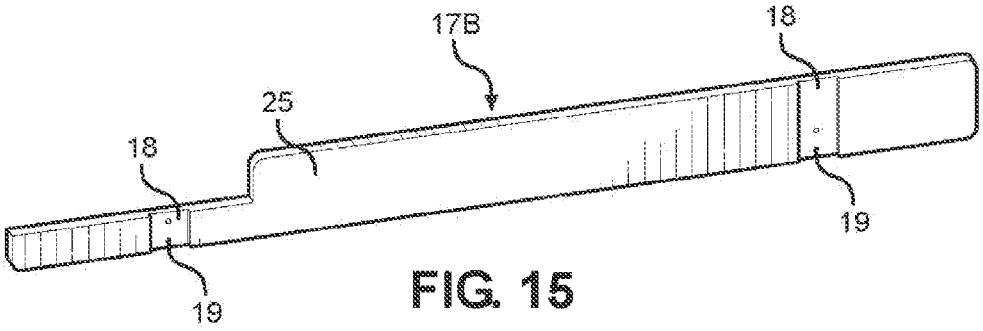
FIG. 15 illustrates a rear wood member.
Figure 16:
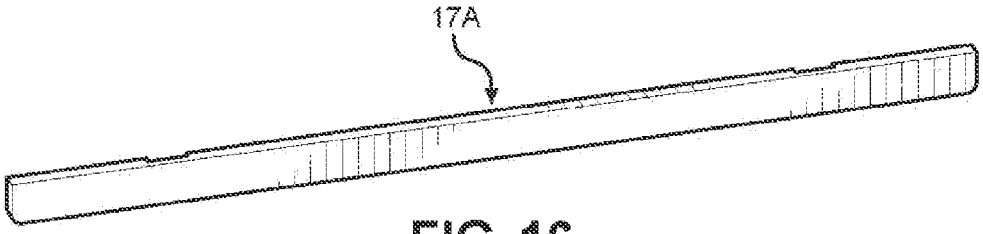
FIG. 16 illustrates outside of a front wood member.
Figure 17:
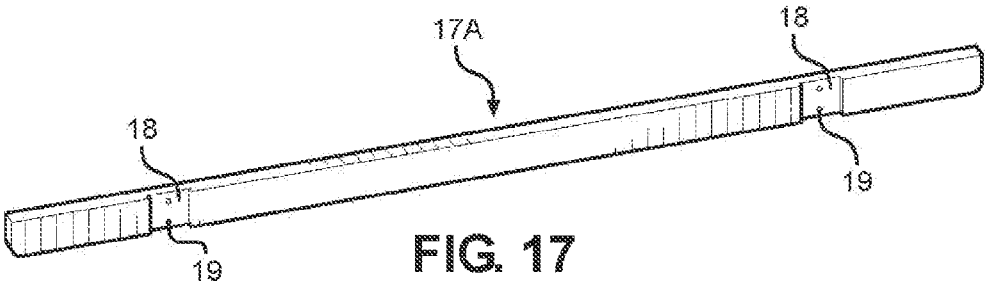
FIG. 17 illustrates the inside of a front wood member.

FIGS. 13-17 illustrate the different types of wood members that can be used to make the bench. FIG. 13 illustrates an asymmetric middle wood member 23 with a raised end 24. The function of the raised end 24 is to limit movement of a cushion placed on the bench. FIG. 14 illustrates symmetric middle wood member 22. The asymmetric middle wood member 23 and the symmetric middle wood member 22 have a pair of wood member openings 16, which are shaped like a circle and are configured to accept crossbar 11. The openings 16 align from one wood member to another to allow crossbar 11 to go through the openings of all middle wood members. FIG. 15 illustrates rear wood member 17B, with a pair of slots 18, with each slot having two fastener receivers 19. Rear wood member 17B is asymmetrical and has a raised portion 25 whose function is to limit movement of any cushion. The raised position is configured to complement the height of the taller vertical portion 8 of U-shaped leg 9. FIGS. 16 and 17 illustrates front wood member 17A, with a pair of slots 18, with each slot having two fastener receivers 19. The fastener receivers 19 on wood members 17A and 17B are configured for attaching these two wood members to the U-shaped leg 1 or 9 with a fastener.

Figure 18:
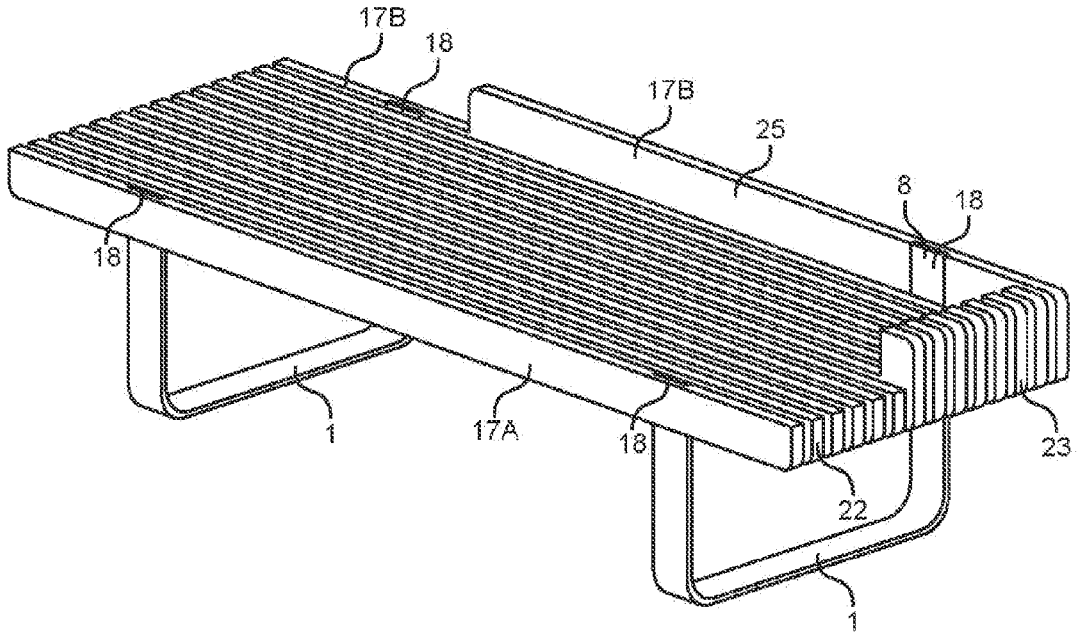
FIG. 18 illustrates a top perspective view of the bench.
Figure 19:
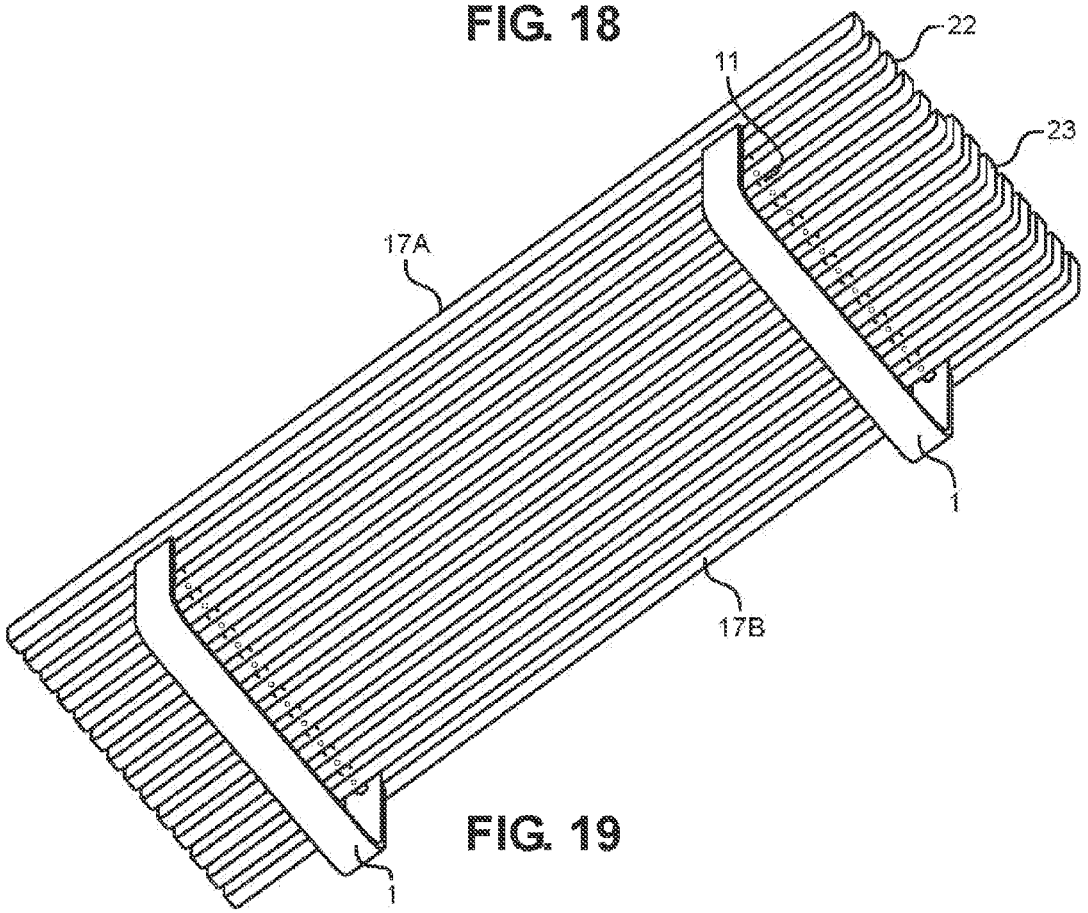
FIG. 19 illustrates a bottom perspective view of the bench.

FIG. 18 illustrates a top perspective view of the bench and FIG. 19 a bottom perspective view of the bench. The front side wood member 17A and the rear side wood member 17B are attached on the outside to U-shaped legs 1 or 9 via the four slots 18. One of the vertical portions 8 of U-shaped legs 9 extends above the seating area of the bench, and complements the raised portion 25 of rear wood member 17B. Symmetric middle wood member 22 and asymmetric middle wood member 23 are placed in between each vertical portion of U-shaped legs 1 and 9. A crossbar 11 goes through the middle wood members 22 and 23, and joins these wood members to the U-shaped legs. The bench has two U-shaped legs 1 and 9, and each U-shaped leg has its own crossbar 11. As illustrated in FIGS. 18 and 19, the bench lacks a frame around wood members 22 and 23. Wood members 22 and 23 have exposed ends and are separated from each other via a gap in between them.

Figure 20:
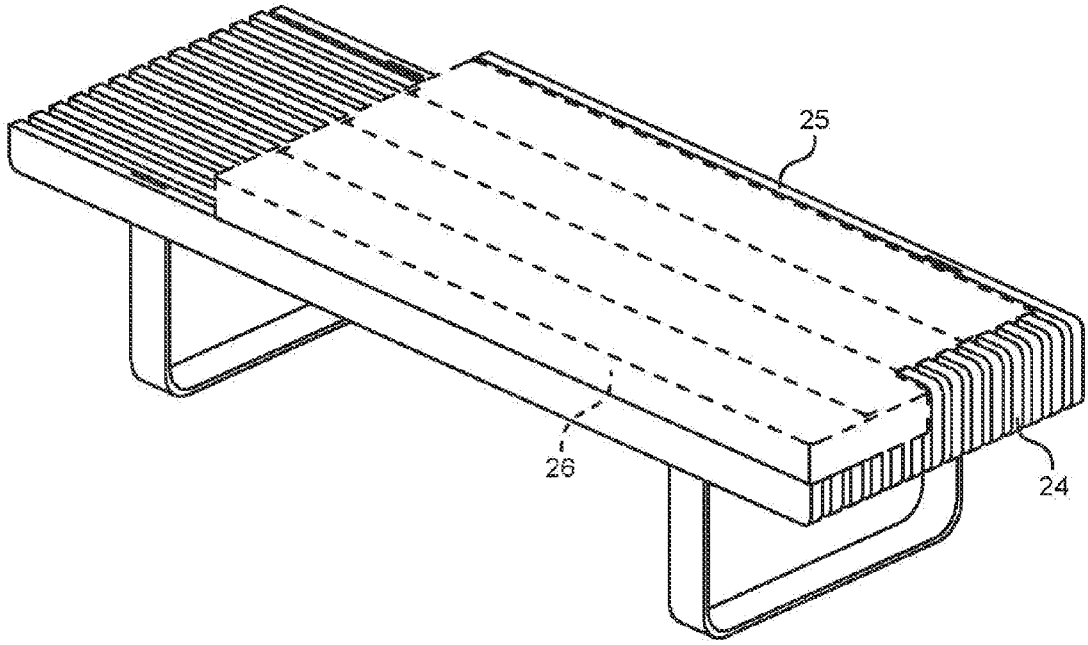
FIG. 20 illustrates a top perspective view of the bench with a cushion.

FIG. 20 illustrates a bench with a cushion 26. The raised portion 25 of rear side wood member 17B and the raised end 24 of asymmetric middle wood member 23 cradle the cushion 26 and limit the movement of the cushion 26.

The members can be made from wood. They can also be made from wooden boards, Mechanically Bonded Fiber (MBF), metal, aluminum, fiber glass, or plastic.

The U-shaped legs can be made from stainless steel, aluminum, carbon fiber, chrome, or plastic, preferably stainless steel. The U-shaped legs can be fabricated from a single piece of material.

The bench can have a length of about 5 feet to about 7 feet, s a width of about 22 inches to about 28 inches, and a height of about 16 inches to about 20 inches, the height measured from top surface of the symmetric middle wood members 22 of the bench.

The number and types of wood members can vary. As illustrated in FIG. 18, there are seven asymmetrical wood members 23 and five symmetrical wood members 22. The number of middle wood members 21 can vary, for example from 8 to 14, such as 12.

The length of the wood members 15 can be about 5 feet to about 7 feet, such as about 6 feet, the thickness of the wood members 15 can be 0.5 inch to 3 inches, such as 1 inch, and the width at portions that are not raised can be 1.5 inches to 6 inches, such as about 3 inch.

REFERENCES

1—U-Shaped leg
2—Vertical portion of U-shaped leg
3—Horizontal portion of U-shaped leg
4—Upper opening for attaching to wood member
5—Lower opening for attaching to wood member
6—Opening for attachment to a bar
7—Circular corner of U-shaped leg
8—Taller vertical portion of U-shaped leg
9—U-shaped leg with uneven vertical portions
10—Matching hole on opening 6
11—Crossbar
12—openings on the surface of the crossbar
13—Opening on end of crossbar
14—Screw (through wood and crossbar)
15—wood member (encompass all wood members)
16—wood member opening
17—front or rear wood member
17A—front wood member
17B—rear wood member
18—Slot of front or rear wood member
19—fastener receiver
20—wood insert:
21—Middle wood members
22—Symmetric middle wood member
23—Asymmetric middle wood member
24—raised end of asymmetric middle wood member
25—raised portion of rear wood member
26—Cushion
27—Middle Wood Member Channel

What is claimed is:

1. A bench comprising:

a) a plurality of parallel middle members, each of the middle members having at least two openings;

b) at least two crossbars with a first end and a second end, each of the crossbars configured to go through one of the two openings, the crossbars having a plurality of diametrically spaced openings on a length of the crossbars, and the middle members having a channel that aligns with the openings on the crossbars;

c) a plurality of legs for attaching to the first end and the second end of the crossbars, the legs making contact with a ground;

wherein the plurality of the middle members are spaced apart from each other in such configuration that each of the two openings align from one of the middle members to another;

wherein each of the crossbars transverses one of the openings of the middle members to be attached to the legs at the first and the second end of the crossbar; and wherein a top surface of the middle members in the configuration attached to the legs define a sitting area of the bench.

2. The bench of claim 1, wherein the bench has a combination of asymmetric and symmetric middle members, the asymmetric members having portions that rise upward and limit lateral movement of a cushion.

3. The bench of claim 1, wherein the middle members have exposed ends without presence of a frame.

4. The bench of claim 1, wherein all of the crossbars are parallel to each other.

5. The bench of claim 1, wherein the openings are circular.

6. The bench of claim 1, wherein the members have a length, a width, and a thickness, and the middle members are positioned in relation to each other in such manner that the width of one member faces the width of another member, and the thickness of the middle members creates the sitting area of the bench.

7. The bench of claim 1, wherein each leg has two types of openings, with one type of opening configured for attachment to the crossbar and one type of opening configured for attachment to a front or a rear member.

8. The bench of claim 1, wherein at least one of the middle members is asymmetric.

9. The bench of claim 1, wherein at least one of the middle members has an asymmetric end to cradle a cushion.

10. The bench of claim 1, wherein the legs are two U-shaped legs, each of the U-shaped legs fabricated from a single piece of material.

11. The bench of claim 10, wherein one of the two U-shaped legs has a first vertical portion of higher height that a second vertical portion, the first vertical portion rising above the sitting area to cradle a cushion.

12. The bench of claim 1, further comprising a fastener, the fastener attaching the middle member to the cross bar by travelling through the channel, then the diametrically spaced openings of the crossbar, and then a portion on the middle member on opposite side of which the fastener entered the diametrically spaced openings.

13. The bench of claim 12, wherein the diametrically spaced openings are configured to receive the fastener in a parallel fashion to a side of the middle member which is a width of the middle member.

14. The bench of claim 1, further comprising a front and a rear member placed on outside of the legs in parallel fashion to the middle members.

15. The bench of claim 14, wherein each of the front and the rear members have two slots, each slot configured to accept a vertical portion of the leg.

16. The bench of claim 15, wherein each of the slots has one or more receivers configured for receiving a fastener.

17. A bench comprising:

a) a plurality of parallel middle members, each of the middle members having at least two openings;

b) at least two crossbars with a first end and a second end, each of the crossbars configured to go through one of the two openings;

c) a plurality of legs for attaching to the first end and the second end of the crossbars, the legs making contact with a ground;

d) a front and a rear member placed on outside of the legs in parallel fashion to the middle members, each of the front and the rear members having two slots, each slot configured to accept a vertical portion of the leg;

wherein the plurality of the middle members are spaced apart from each other in such configuration that each of the two openings align from one of the middle members to another;

wherein each of the crossbars transverses one of the openings of the middle members to be attached to the legs at the first and the second end of the crossbar; and wherein a top surface of the middle members in the configuration attached to the legs define a sitting area of the bench.

18. A bench comprising:

a) a plurality of parallel middle members, each of the middle members having at least two openings through a thickness of the middle members, and two channels configured for accepting fasteners;

b) two crossbars with a first end and a second end, each of the crossbars configured to go through one of the two openings, the crossbar further comprising a plurality of diametrically spaced openings along a length of the crossbar;

c) two U-shaped legs for attaching to the first end and the second end of the crossbars, the legs making contact with a ground;

d) a front member for attaching to outside of the two U-shaped legs;

e) a rear member for attaching to outside of the two U-shaped legs;

wherein the plurality of the middle members are spaced apart from each other in such configuration that each of the two openings align from one of the middle members to another;

wherein each of the crossbars transverses one of the openings of the middle members to be attached to the legs at the first and the second end of the crossbar;

wherein the diametrically spaced openings on the crossbar align with the channel on the middle members so that the middle members can be fastened to the crossbar; and wherein a top surface of the middle members in the configuration attached to the legs define a sitting area of the bench.

19. The bench of claim 18, wherein one of the two U-shaped legs has a vertical portion that extends above the sitting area to cradle a cushion.

* * * * *